US005564706A

United States Patent [19]

Eller et al.

[11] Patent Number: 5,564,706

[45] Date of Patent: Oct. 15, 1996

[54] PRACTICE PUTTING GREEN

[75] Inventors: James Eller, Mundelein; Brian S. Clark, Naperville, both of Ill.

[73] Assignee: Clark Recreation, Ltd., Addison, Ill.

[21] Appl. No.: 387,064

[22] Filed: Feb. 13, 1995

[51] Int. Cl.[6] ..... A63B 69/36

[52] U.S. Cl. ..... 473/160

[58] Field of Search ..... 273/176 R, 176 E, 273/176 H, 178 R, 178 B

[56] References Cited

U.S. PATENT DOCUMENTS 1,582,237 4/1926 Angell ..... 273/176 H 4,988,106 1/1991 Coonrod ..... 273/176 H X

*Primary Examiner*—William H. Grieb

*Attorney, Agent, or Firm*—Patnaude, Videbeck & Marsh

[57] ABSTRACT

A practice putting green has an upper surface of material which simulates the green of a golf course and a support which raises the material of the upper surface upon which the practice putting green is positioned. The practice putting green has a generally rectangular shape with long and short sides, and to simulate the slope of a putting green, a support under one of the long sides of the upper surfaces raises that long side of the upper surface to a higher elevation above the underlying surface than the opposing long side. One or more wedges are also provided which may be positioned below the support to create a more uneven playing surface.

5 Claims, 1 Drawing Sheet

PRACTICE PUTTING GREEN

The present invention relates to artificial or practice putting greens, and specifically to the type which is made of a flexible material so as to be easily rolled for storage purposes.

BACKGROUND OF THE INVENTION

A golfer who seeks to improve his score will concentrate on improving the range and accuracy of his drives and the accuracy of his putts. Practice putting greens consisting of a flexible artificial turf and a simulated pin hole are available such that golfers can practice putting inside their home of office. Such practice greens, however, do not simulate the uneven characteristics of greens which are found on golf courses. For example, greens on golf courses are rarely level. One of the greatest challenges of the game of golf is to putt so as to anticipate the movement or break of a golf ball as it rolls across a sloping green.

The grass on a properly maintained green is very short, and, as a result, good putting is greatly dependent upon the player's skill in playing the curve and contours of the putting surface. A golf ball can be expected to "break" or turn as gravity draws the moving ball towards the downward slope of the green.

Previously existing practice putting greens have not simulated the uneven playing surface of a golf course green and, therefore, previously existing practice putting greens cannot be used to improve the players skill of anticipating the break of a ball as it rolls across an uneven surface. It would be desirable, therefore, to provide an practice putting green which has an uneven playing surface such that a golfer can improve his skill in anticipating the break of a ball.

SUMMARY OF THE INVENTION

Briefly, the present invention is embodied in a practice putting green which has an upper surface of material which simulates the green of a golf course. Below the material of the upper surface is a support which raises the upper surface above the surface upon which the practice putting green is positioned. In accordance with the present invention, a first portion of the material which forms the upper surface is supported a greater distance above the surface upon which the practice putting green is positioned than is a second portion of the upper surface of material.

In the preferred embodiment, the practice putting green is rectangular in shape with a length which is substantially longer than the width, and a cup or hole which simulates the hole of a golf course positioned near one or both of the shorter sides of the rectangle. To simulate a sloping surface of a green, the support under one of the long edges of the surface raises the upper surface therealong to a higher elevation above the underlying surface than the opposing long edge. In the preferred embodiment, the support is a flexible foam material which can be cut or cast to the desired thickness and positioned under the material which forms the upper surface of the practice putting green. Where the foam is thicker along one of the long sides than along the opposing long side, and the practice green is positioned on a level surface, the practice putting surface will be uneven. Furthermore, the holes are cut through both layers of material, one near each of the short ends of the rectangular putting surface to simulate the holes of a putting green. As a result, the practice green can be used to simulate a green which will break to the left or the right depending on which direction a golf ball rolls along the length of the practice green.

To provide additional irregularities in the surface of the practice green so as to further simulate the surface of a true golf course green, one or more wedges may be positioned at various locations under the foam support of a practice putting green in accordance with the present invention.

BRIEF DESCRIPTION OF THE DRAWINGS

A better understanding of the present invention may be had after a reading of the following specification taken in conjunction with the drawings in which.

DETAILED DESCRIPTION OF A PREFERRED EMBODIMENT

Figure 1:
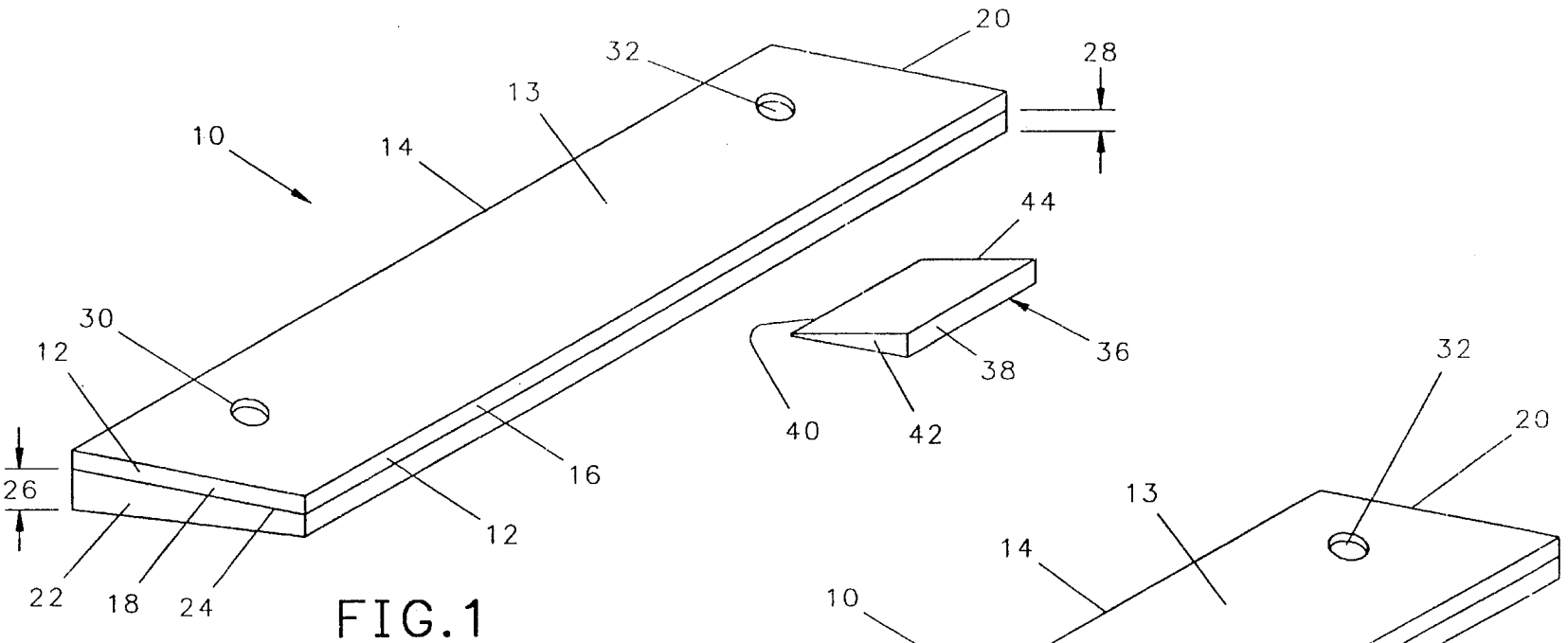
FIG. 1 is an isometric view of an artificial green in accordance with the present invention and a wedge which may be used in conjunction therewith to alter the contour of the upper surface.
Figure 2:
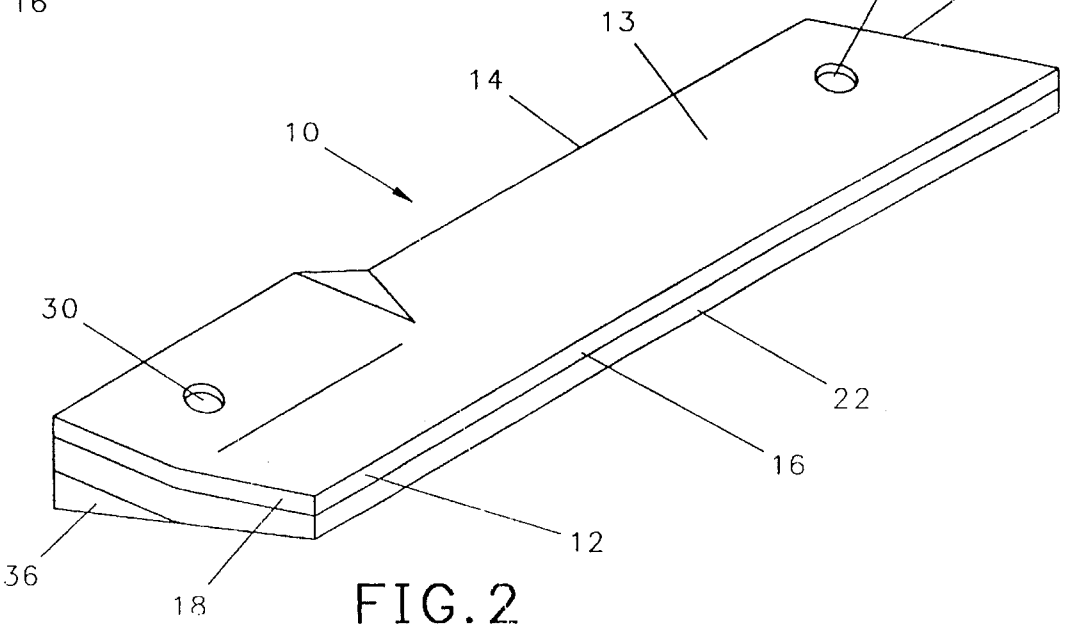
FIG. 2 is a second isometric view of a practice putting green in accordance with the present invention in which the wedge has been fitted under a portion thereof.

Referring to FIGS. 1 and 2, the practice putting green 10 has an upper layer of material 12, the upper surface 13 of which is adapted to simulate the green of a golf course. Such simulated turfs are pliable and are well known in the art. The upper material 12 is configured as a rectangular panel having long sides 14, 16, and short sides 18, 20. In the preferred embodiment, the long sides 14, 16 are nine feet long, and the short sides 18, 20 are two feet long. Below the upper material 12 is a support 22 having outer dimensions equal to the dimensions of the upper material 12. In the preferred embodiment, the support is a pliable foam, such as a foam rubber or the like, which is bonded by an adhesive 24 to the lower surface of the upper material 12. As can be seen in FIGS. 1 and 2, the support 22 has a substantially uniform thickness 26 along one side 14. Similarly, the support 22 has a second thickness 28 which is substantially uniform along the second long side 16, however, the thickness 28 along slide 16 is less than the thickness 26 along side 14. Preferably, thickness 26 is about one inch, and thickness 28 is about one-half inch. As a result, when a practice green 10 consisting of the upper layer of material 12 and support 22 is positioned on a substantially level surface, the upper surface 13 of the practice putting green will slope downward from the higher long side 14 toward the lower long side 16.

Positioned near short side 18 is a first hole 30 having a diameter of about four inches to simulate the cup of a golf course green. The first hole 30 extends through both the upper material 12 and the support 22. Similarly, near short side 20 is a second hole 32 which also extends through the upper material 12 and support 22 to simulate a second hole. A ball putted from a position near the short end 20 and toward the first hole 30 will, therefore, tend to break to the left and toward the lower side 16. Similarly, a ball putted from short side 18 toward second hole 32 will tend to break to the right, that is, it will turn toward long side 16.

To further simulate the uneven terrain of a putting green, one or more wedges 36 may be provided. In the preferred embodiment, each wedge 36 has a body with a generally rectangular perimeter with long sides 38, 40 and short sides 42, 44. The body of the wedge 36 has a thickness of approximately one inch along long side 38, and the thickness tapers downward to approximately 1/16 inch along long edge 40. In the preferred embodiment, the wedge 36 may be made of a durable foam material such as polyurethane, with the long sides 38, 40 each being about 18 inches long, and the short sides 42, 44 each being about 6 inches long.

Referring to FIG. 2, one or more wedges 36 may be positioned upon a level underlying surface 46 and under portions of the support 22 to further provide irregularities in the upper surface 13 of a practice green 10.

While one preferred embodiment of the present invention has been disclosed, it will be apparent to those skilled in the art that many changes and modifications may be made without departing from the true spirit and scope of the invention. It is the purpose of the appended claims to cover all such changes and modifications which fall within the true spirit and scope of the invention.

What is claimed:

1. A practice putting green comprising in combination:

a first elongate flexible panel having an upper surface for use as a putting green and a lower surface, a second elongate flexible panel below said first flexible panel, said second elongate flexible panel having a first long side and a second long side, said second panel having an upper surface attached to said lower surface of said first panel, and said second panel having a thickness along said second long side which is greater than a thickness of said second panel along said first long side.

2. A practice putting green in accordance with claim 1 wherein said second flexible panel has a first uniform thickness along said first side and a second uniform thickness along said second side, said second uniform thickness being greater than said first uniform thickness.

3. A putting green in accordance with claim 1 further comprising a wedge for insertion below a portion of said second flexible panel.

4. A practice putting green in accordance with claim 1 further comprising a first hole extending through said first flexible panel and said second flexible panel and positioned near one end of said elongate panel.

5. The practice putting green in accordance with claim 4 and further comprising a second hole through said first flexible panel and said second flexible panel and positioned near a second end of said elongate panel.

* * * * *